US012635752B1

(12) United States Patent
Yang

(10) Patent No.: US 12,635,752 B1
(45) Date of Patent: May 26, 2026

(54) POWER SUPPLY DEVICE FOR HELMET SHIELD WITH ELECTRIC HEATING WIRE

(71) Applicant: BO CAI ENTERPRISE CO., LTD., Tainan (TW)

(72) Inventor: Zhong Qi Yang, Tainan (TW)

(73) Assignee: BO CAI ENTERPRISE CO., LTD., Tainan (TW)

( * ) Notice: Subject to any disclaimer, the term of this patent is extended or adjusted under 35 U.S.C. 154(b) by 0 days.

(21) Appl. No.: 19/038,648

(22) Filed: Jan. 27, 2025

(30) Foreign Application Priority Data

Nov. 26, 2024 (TW) ..... 113145445

(51) Int. Cl.
*A42B 3/04* (2006.01)
*A42B 3/24* (2006.01)
*A42B 3/28* (2006.01)

(52) U.S. Cl.
CPC ..... *A42B 3/0406* (2013.01); *A42B 3/245* (2013.01); *A42B 3/285* (2013.01)

(58) Field of Classification Search
CPC ..... A42B 3/0406; A42B 3/285; A42B 3/24; H05B 3/84; H05K 5/0247
See application file for complete search history.

(56) References Cited

U.S. PATENT DOCUMENTS 4,584,721 A * 4/1986 Yamamoto ..... A42B 3/245 219/203
5,165,117 A * 11/1992 Kamata ..... A42B 3/223 2/424
8,166,576 B2 * 5/2012 Kato ..... A42B 3/223 2/424
2004/0049830 A1 * 3/2004 Gafforio ..... A42B 3/222 2/171
2005/0180129 A1 * 8/2005 Harris ..... A42B 3/30 362/105
2010/0064405 A1 * 3/2010 Mcgovern ..... A42B 3/225 2/424
2011/0283431 A1 * 11/2011 Miller, IV ..... G02C 7/101 2/10
2012/0011641 A1 * 1/2012 Ahn ..... A42B 3/24 2/439

(Continued)

*Primary Examiner* — Alissa L Hoey
*Assistant Examiner* — Akwokwo Olabisi Redhead
(74) *Attorney, Agent, or Firm* — Che-Yang Chen; Law Office of Michael Chen

(57) ABSTRACT

A power supply device for a helmet shield with an electric heating wire, comprising: a helmet shell having hinge sections on both sides and a flip-up shield attached at the front section thereof. The device is mounted on one of the hinge sections, comprising: a spacer integrated with the hinge section, the spacer including a shield seat on the outer side designed to engage with a shield incorporating an embedded electric heating wire; an electrical transfer assembly integrated within the spacer, with its one end connected to a power interface assembly; and an electrical contact assembly mounted on the shield, which aligns with and contacts with the electrical transfer assembly when the shield is secured to the shield seat. The power interface assembly is configured to sequentially deliver electrical power through the device to the electric heating wire, ensuring effective defogging of the shield by dissipating moisture.

6 Claims, 5 Drawing Sheets

(56) References Cited

U.S. PATENT DOCUMENTS

| | | | | |
|---|---|---|---|---|
| 2013/0093585 | A1* | 4/2013 | Ambani | B62J 6/045 340/475 |
| 2018/0077995 | A1* | 3/2018 | Dutour | A42B 3/245 |
| 2018/0168269 | A1* | 6/2018 | Di Troia | A42B 3/224 |
| 2018/0228247 | A1* | 8/2018 | Müller | A43B 17/03 |
| 2020/0225488 | A1* | 7/2020 | Goupil | G02B 27/0172 |

* cited by examiner

POWER SUPPLY DEVICE FOR HELMET SHIELD WITH ELECTRIC HEATING WIRE

FIELD OF INVENTION

The present invention relates to helmets, in particular to a power supply connection mechanism for an electric heating wire integrated in a helmet shield. This mechanism prevents the formation of fog on the shield, thereby ensuring clear visibility during use.

BACKGROUND OF THE PRESENT INVENTION

Helmets are generally classified into flip-up full-face helmets and full-face helmets. Both types share similar structural designs, with flip-up helmets having movable front shields that can be lifted up to facilitate donning and doffing and activities such as eating. Full-face helmets, on the other hand, cover the entire head and offer superior protection. When used in racing or in cold environments, the fully enclosed design of these helmets presents challenges such as difficulty in donning and doffing and the inability to eat while wearing them. Particularly in cold weather, the temperature difference between the exhaled air of the rider and the ambient environment causes the helmet shield to fog up, reducing visibility. Various anti-fog solutions have been proposed to address this problem. For example, U.S. Pat. No. 6,748,607 discloses a breathing protection assembly for helmets that prevents vapor from forming on the helmet shield, thereby improving user comfort. Similarly, Chinese Patent No. CN202021816407.9 describes a heated anti-fog shield with transparent heating elements or layers that provide excellent defogging performance at low temperatures. The patent also introduces strip electrodes on the both sides of the same heating layer surface that will not obstruct visibility. The heated anti-fog helmet of the present invention includes such a heated anti-fog shield and may also incorporate an electric heating film within the liner of the helmet shell to provide head warmth in cold conditions and enhancing wearing comfort.

Despite these advances, existing solutions often require external components to power the heating system, which can compromise the design and usability of the helmet. For example, Taiwan Patent No. 101200254 describes a power supply indicator device attached to a helmet shell. This device uses an electric heating wire surrounding the shield surface to generate heat when electrified, evaporating water droplets and maintaining visibility in rainy conditions, thereby effectively preventing accidents. However, the external protrusion of the power supply indicator device detracts from the aesthetics of the helmet and is prone to becoming detached in the event of an impact, causing the defogging system to lose its function and posing a safety risk while riding.

SUMMARY OF THE PRESENT INVENTION

Given that current helmet defogging systems predominantly rely on externally mounted components that often detract from the aesthetics of the helmet. These external devices are susceptible to becoming detached during a collision or impact, thereby compromising their reliability and increasing inconvenience during use.

The purpose of the present invention is to integrate a defogging device into the existing helmet mechanisms by embedding power supply connection components within the helmet in order to solve the problems of the existing technologies that may affect riding safety.

In order to achieve the above purpose, the present invention introduces a power supply device for a helmet shield equipped with an electric heating wire, comprising: A helmet shell provided on both sides with pivoting parts on which a shield is pivotally mounted. The shield incorporates an electric heating wire surrounding its periphery, with pivot apertures at each end and locking tabs positioned around the pivot apertures; a spacer integrated with the hinge section of the helmet shell. The spacer includes at least one assembly hole and multiple fastening apertures. The assembly hole extends through the spacer and aligns with the pivot aperture while connecting to a mounting recess with a diameter greater than that of the assembly hole and oriented toward the helmet shell. An accompanying shield seat is positioned at the outer side of the spacer, with a retention recess designed to accommodate the locking tab of the shield, thereby securing it in place; an electrical transfer assembly comprising a conductive screw and a nut. The conductive screw passes through the assembly hole and is fastened to the nut positioned within the mounting recess; an electrical contact assembly mounted on the outer side of the shield's pivot aperture. This assembly comprises a contact terminal housed within an outer cover. The contact terminal includes a contact surface and a connection end which connects to the electric heating wire via a power wire, and the contact surface is configured to make contact with the conductive screw; a power interface assembly, which comprises a power socket, a power wire, and an electrical connector plate. The electrical connector plate, a plate structure with two terminal ends, connects at one end to the power wire and at the other end to the electrical contact assembly. The power wire also has two ends, with one end connected to the electrical connector plate and the other end electrically connected to the power socket; and a power supply that is electrically connected to the power socket.

Wherein, an inner cover is mounted on the inner side of the helmet shell. This inner cover, together with the spacer, is securely attached to the hinge section of the helmet shell using fasteners.

Wherein, the outer cover of the device is designed with multiple alignment posts on its inner surface. These alignment posts correspond to and engage with multiple locking recesses positioned around the pivot aperture of the shield.

Wherein, the power socket is positioned at the bottom of the helmet shell. This power socket comprises a power input socket and a Universal Serial Bus (USB) or USB Type-C interface. The power input socket facilitates the connection of the power wire, which subsequently connects to the power supply.

Wherein, the power supply for the device is a vehicle battery.

Wherein, the power socket is further connected to a lithium battery. This lithium battery, which is designed to be placed inside the helmet, is electrically connected to the USB socket, facilitating auxiliary connections such as to Bluetooth headphones.

Based on the above, the electrical power is sequentially transmitted from the primary power supply to the power socket via connection terminals. The current is then transmitted via the power wire to the electrical connector plate, proceeding through the electrical transfer assembly and the electrical contact assembly, before finally supplying the electric heating wire. This systematic configuration ensures the effective removal of the moisture-laden hot air exhaled within the helmet shell, preventing fogging of the shield and maintaining clear visibility for safe operation.

DETAILED DESCRIPTION OF THE PREFERRED EMBODIMENTS

Figure 1:
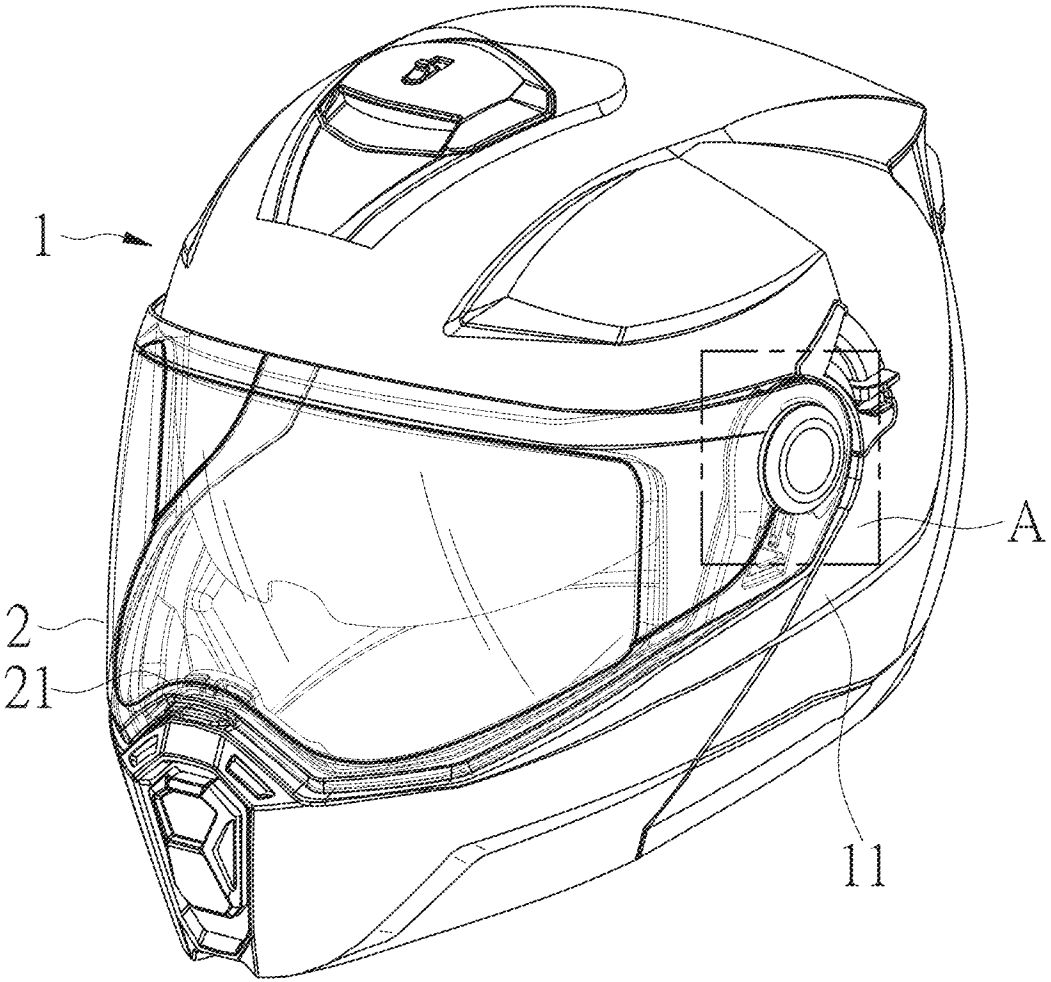
FIG. 1 schematically shows the installation position of the present invention.

In order to provide a comprehensive disclosure of the technical features and operation for achieving the purpose of the present invention, the following detailed description is provided with reference to the accompanying drawings and reference numerals:

Referring to FIG. 1, the disclosed invention relates to a power supply device A integrated into a helmet shell 1 for supporting a shield 2 equipped with an electric heating wire 21. The helmet shell 1 has the shield 2 attached to its front section, with hinge sections 11 positioned symmetrically on either side. The shield 2 is pivotally connected to these hinge sections 11, facilitating a rotational movement while incorporating the electric heating wire 21 embedded on its inner surface. In addition, the power supply device A is mounted on one of the hinge sections 11.

Figure 2:
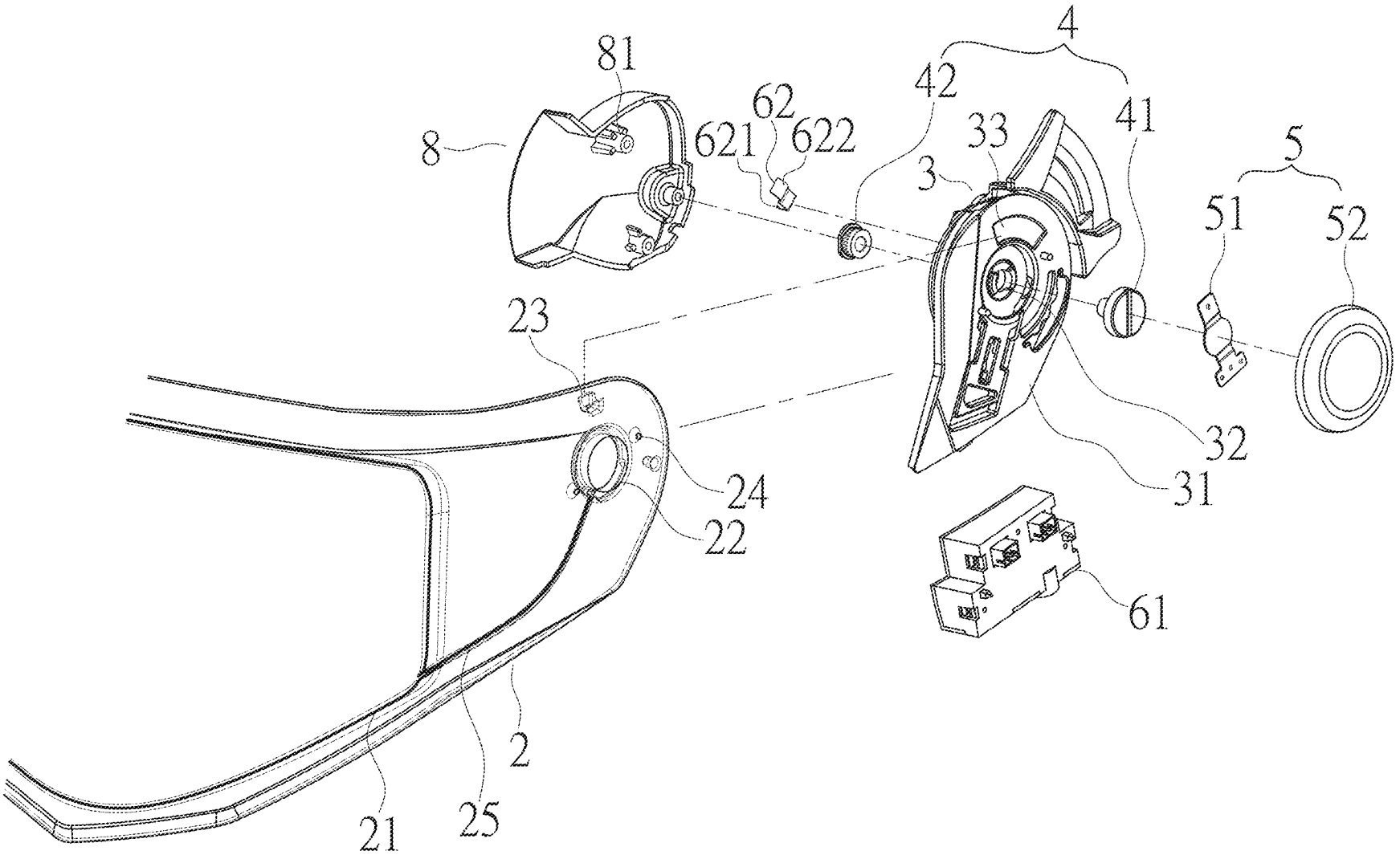
FIG. 2 schematically shows an exploded perspective view of the present invention.
Figure 3:
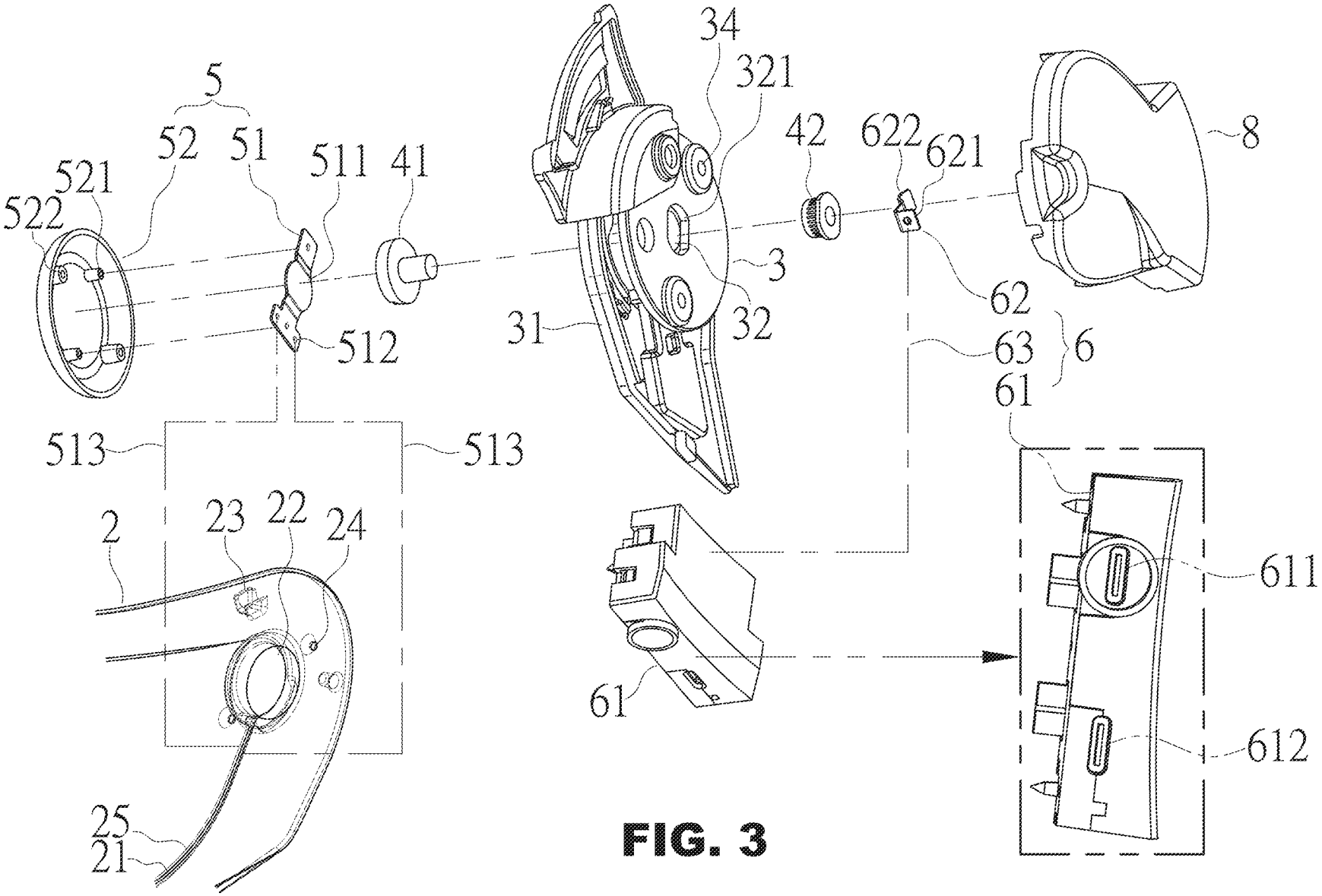
FIG. 3 schematically shows an exploded perspective view of the present invention from another angle.

Referring to FIGS. 2-3, the power supply device A comprises a spacer 3, to which a shield seat 31 is positioned at one side. The spacer 3 is characterized by an assembly hole 32 and multiple fastening apertures 34 situated at its central position, while the shield seat 31 has a retention recess 33. The shield 2, positioned at both ends, includes pivot apertures 22 encircled by a protruding locking tab 23 and multiple locking recesses 24. Upon assembly, the locking tab 23 inserts into the retention recess 33 of the shield seat 31, aligning the pivot aperture 22 with the assembly hole 32 of the spacer 3. In a further embodiment of the present invention, the shield 2 incorporates a wiring channel 25 between the pivot aperture 22 and its surface. This channel accommodates the electric heating wire 21 to ensure operational functionality. An electrical transfer assembly 4 is integrated into the assembly hole 32 of the spacer 3. This assembly comprises a conductive screw 41 and a nut 42. In addition, an electrical contact assembly 5, mounted on the shield 2, consists of a contact terminal 51 and an outer cover 52. The contact terminal 51 is housed within the outer cover 52 and includes a contact surface 511 and a connection end 512. The connection end 512 links to a power wire 513, which connects to the electric heating wire 21. After installation, the contact surface 511 of the contact terminal 51 establishes contact with the conductive screw 41 of the electrical transfer assembly 4. A power interface assembly 6, comprising a power socket 61 and an electrical connector plate 62. The electrical connector plate 62, a plate structure with two terminal ends, connects at one end to a power wire 63 and at the other end to the electrical transfer assembly 4. The power wire 63, with two ends, connects at one end to the electrical connector plate 62 and at the opposite end to the power socket 61, ensuring a reliable electrical pathway.

Figure 4:
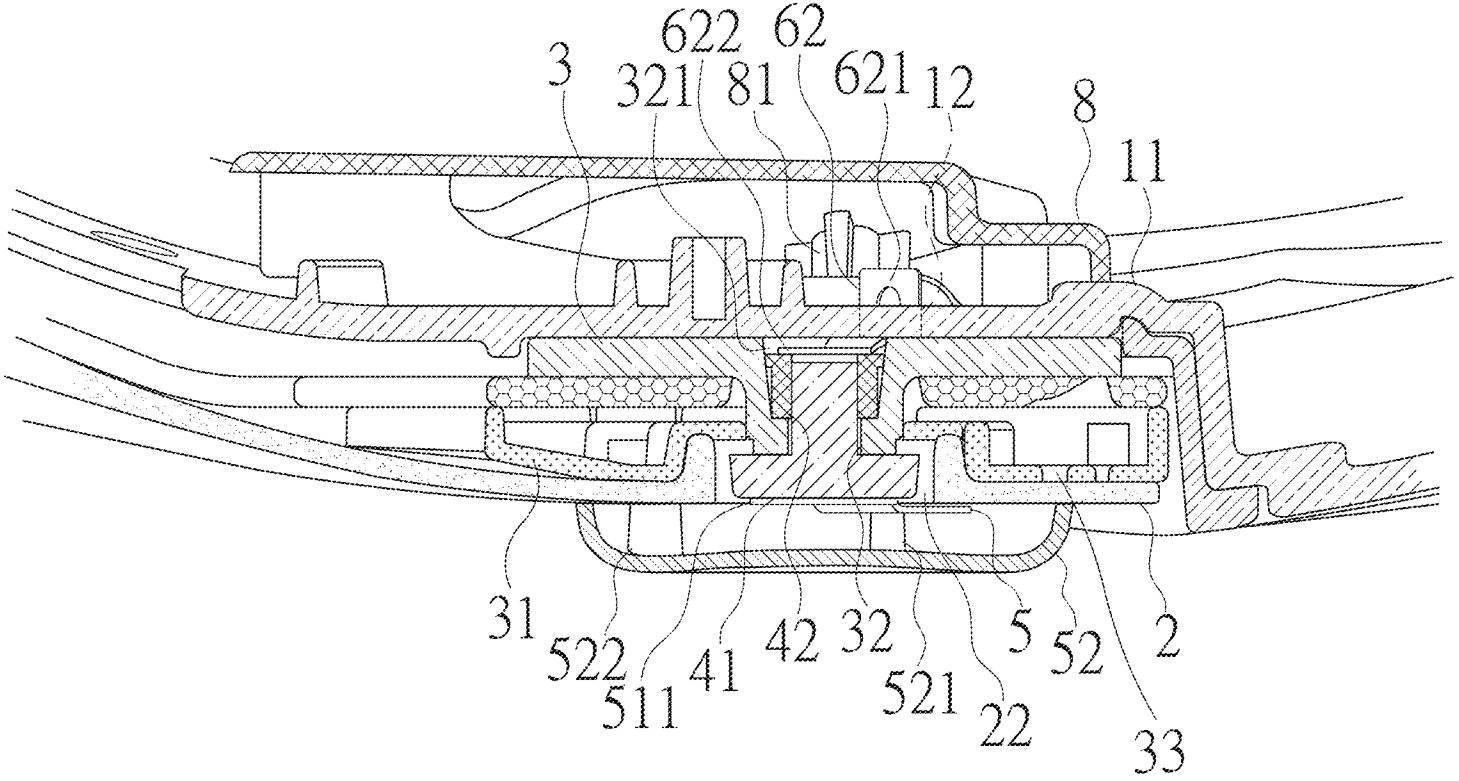
FIG. 4 shows a sectional view of the present invention.

Referring to FIGS. 3-4, the assembly process for the device begins by inserting the conductive screw 41 of the electrical transfer assembly 4 through the assembly hole 32 of the spacer 3 from the outside to the inside. The assembly hole 32 connects to a mounting recess 321, which has a diameter greater than that of the assembly hole 32 and is oriented toward the helmet shell 1. The nut 42 is positioned within the mounting recess 321, where it engages with the conductive screw 41 to form the electrical transfer assembly 4. Subsequently, the contact terminal 51 is secured to an anchor post 521 within the outer cover 52 using either screwing or adhesive techniques. The power wire 513 is then soldered to the connection end 512 of the contact terminal 51 to complete the circuit. Alignment posts 522 on the inner surface of the outer cover 52 are then inserted into the locking recesses 24 of the shield 2, thereby coupling the electrical contact assembly 5 to the shield 2. In this configuration, the contact surface 511 of the contact terminal 51 is aligned within the pivot aperture 22 of the shield 2. The power wire 513 is routed through the wiring channel 25 of the shield 2, establishing a connection with the electric heating wire 21. Finally, the locking tab 23 of the shield 2 is inserted into the retention recess 33 of the shield seat 31, securing the shield 2 and shield seat 31 as a cohesive unit. This assembly ensures that the contact surface 511 of the contact terminal 51 remains in contact with the conductive screw 41.

Figure 5:
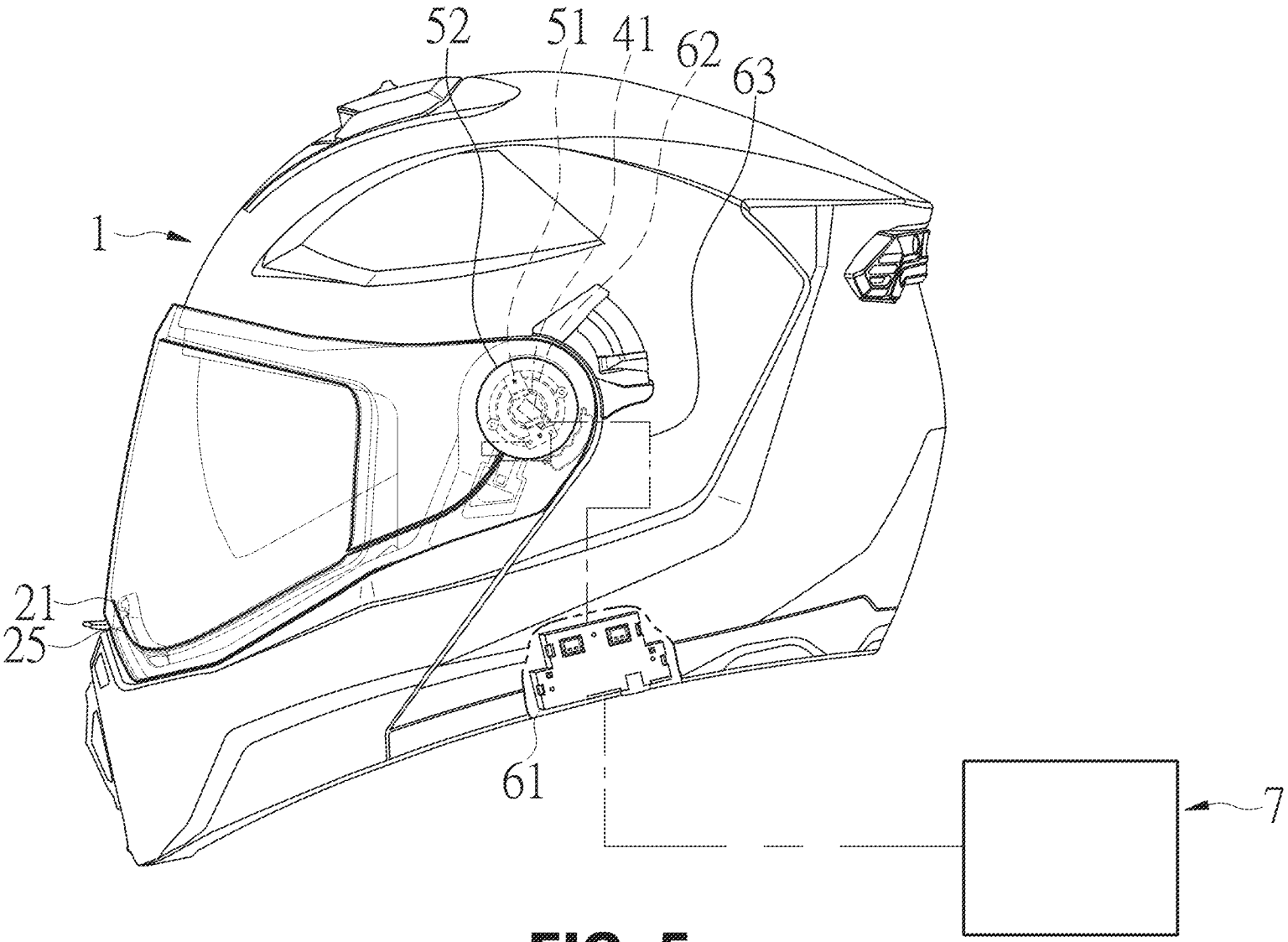
FIG. 5 schematically shows a power connection of the present invention.

Referring further to FIGS. 4-5, the spacer 3 is mounted on the hinge section 11 of the helmet shell 1. The helmet shell 1 includes a through hole 12, which is aligned with and communicates with the mounting recess 321 of the spacer 3. The electrical connector plate 62 is configured as an L-shaped conductive spring plate, having a connection end 621 and a contact end 622. When the spacer 3 is securely mounted to the helmet shell, the contact end 622 establishes an electrical connection with either the nut 42 or the conductive screw 41 of the electrical transfer assembly 4. The connection end 621 protrudes toward the inner surface of the helmet shell and connects to the power wire 63, then using an inner cover 8 to enclose the protruding connection end 621, thereby preventing potential scratches to the wearer. Meanwhile, using fasteners (not shown) to pass through screwing apertures 81 on the inner cover 8 and the helmet shell 1, aligning with and securing to the fastening apertures 34 of the spacer 3. One end of the power wire 63 connects to the electrical connector plate 62, while the opposite end is electrically connected to the power socket 61. The power socket 61 is mounted on the inner bottom of the helmet shell and incorporates at least one power input socket 611 and a USB socket 612. The power input socket 611 facilitates connection to an external power supply 7, such as a vehicle battery. In an alternative embodiment, a lithium battery (not shown) can be integrated into the helmet and connected to the USB socket 612 of the power socket 61. This configuration enables the lithium battery to supply power to peripheral devices such as Bluetooth headphones.

The present invention facilitates the transmission of power from the power supply 7 through connection terminals to the power socket 61. From the power socket 61, electricity is sequentially transmitted via the power wire 63 to the electrical connector plate 62, then through the electrical transfer assembly 4 and the electrical contact assembly 5, before finally being delivered to the electric heating wire 21 via the power wire 513. This mechanism effectively defogs the moisture-laden hot air generated by the user's exhalation within the helmet shell 1, ensuring the shield 2 remains clear and unobstructed, thereby maintaining optimal driving visibility.

Accordingly, the power supply device for the helmet shield equipped with the electric heating wire as disclosed in the present invention, has the following advantages:

1. The present invention incorporates the power supply connection components into the existing flip-up mechanism of the helmet. This integration ensures that the power supply device is entirely concealed within the structure of the helmet, maintaining its external aesthetics and structural safety.
2. The power socket is mounted on the inner bottom of the helmet shell. This installation simplifies the process of connecting or disconnecting the helmet from an external power source, such as a vehicle battery, while minimizing the risk of contact issues caused by accidental pulling or strain on the connection.
3. The concealed architecture of the power socket prevents it from being detached by external impacts or collisions, ensuring uninterrupted functionality and improved riding safety.

The foregoing description is merely a preferred embodiment of the present invention and is not intended to limit the scope of implementation or the sequence of assembly of the present invention. Any variations or modifications made without departing from the basic technical principles of the present invention are to be regarded as falling within the scope of the claims of this patent.

In summary, the present invention has successfully surpassed conventional designs and offers significant advancements and innovative features that are both practical and implementable. These attributes are consistent with the statutory requirements for patents. Accordingly, this patent application is filed in accordance with legal procedures. Your consideration and approval will be greatly appreciated.

What is claimed is:

1. A power supply device for a helmet shield with an electric heating wire, comprising: a helmet shell having hinge sections on both sides, a shield attached at the front section of the shell, pivot apertures at both ends of the shield, locking tabs positioned around the pivot apertures, the pivot apertures being mounted on the hinge sections, and an electric heating wire embedded on an inner surface of the shield, wherein the power supply device is mounted on one of the hinge sections and comprises: a spacer integrated with the hinge section of the helmet shell, the spacer having at least one assembly hole and multiple fastening apertures, the assembly hole extending through the spacer and connecting to a mounting recess with a diameter greater than that of the assembly hole and oriented toward the helmet shell, and a shield seat positioned at the outer side of the spacer, the shield seat having a retention recess configured to accommodate and secure the locking tab of the shield; an electrical transfer assembly comprising a conductive screw and a nut, wherein the conductive screw extends through the assembly hole and is fastened to the nut positioned within the mounting recess; an electrical contact assembly mounted on the outer side of the shield, the electrical contact assembly comprising a contact terminal housed within an outer cover, the contact terminal including a contact surface and a connection end, the connection end electrically connected to the electric heating wire, and the contact surface configured to establish contact with the conductive screw; a power interface assembly comprising a power socket, a power wire, and an electrical connector plate, wherein the electrical connector plate is a plate structure having two terminal ends, one end connected to the power wire and the other end connected to the electrical contact assembly, and the power wire has two ends, one end connected to the electrical connector plate and the other end electrically connected to the power socket; and a power supply electrically connected to the power socket wherein the contact surface of the contact terminal is aligned within the pivot apertures of the shield, and the power wire is routed through a wiring channel of the shield to establish a connection with the electric heating wire.

2. The power supply device for a helmet shield with an electric heating wire according to claim 1, wherein an inner cover is mounted on the inner surface of the helmet shell and, together with the spacer, is securely attached to the hinge section of the helmet shell using fasteners.

3. The power supply device for a helmet shield with an electric heating wire according to claim 1, wherein the outer cover includes multiple alignment posts positioned on its inner surface, which correspond to and engage with multiple locking recesses positioned around the pivot aperture of the shield.

4. The power supply device for a helmet shield with an electric heating wire according to claim 1, wherein the power socket is positioned at the bottom of the helmet shell and comprises a power input socket and a USB or USB Type-C socket, with the power input socket designed to facilitate the connection of the power wire electrically connected to the power supply.

5. The power supply device for a helmet shield with an electric heating wire according to claim 4, wherein the power socket is connected to a lithium battery placed inside the helmet, the lithium battery being electrically connected to the USB or USB Type-C socket, which is further configured to electrically connect to Bluetooth headphones.

6. The power supply device for a helmet shield with an electric heating wire according to claim 1, wherein the power supply is a vehicle battery.

* * * * *